US007766525B2

(12) United States Patent
Rosenbauer et al.

(10) Patent No.: US 7,766,525 B2
(45) Date of Patent: Aug. 3, 2010

(54) HOUSEHOLD APPLIANCE, PARTICULARLY BUILT-IN HOUSEHOLD APPLIANCE

(75) Inventors: Michael Rosenbauer, Reimlingen (DE); Bernd Schessl, Dillingen/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 597 days.

(21) Appl. No.: 10/539,825

(22) PCT Filed: Dec. 4, 2003

(86) PCT No.: PCT/EP03/13723

§ 371 (c)(1),
(2), (4) Date: May 5, 2006

(87) PCT Pub. No.: WO2004/056257

PCT Pub. Date: Jul. 8, 2004

(65) Prior Publication Data

US 2006/0232997 A1 Oct. 19, 2006

(30) Foreign Application Priority Data

Dec. 19, 2002 (DE) ..... 102 59 762

(51) Int. Cl.
*F21V 7/04* (2006.01)
*A47L 9/30* (2006.01)

(52) U.S. Cl. ..... 362/551; 362/89; 362/91; 362/29; 362/154; 362/155; 362/317; 362/362; 362/555

(58) Field of Classification Search ..... 362/551, 362/555, 127, 154, 155, 133, 317, 362, 89, 362/91, 26–30; 40/541
See application file for complete search history.

(56) References Cited

U.S. PATENT DOCUMENTS

| | | | | |
|---|---|---|---|---|
| 6,204,459 | B1 | 3/2001 | Kizele et al. | |
| 2003/0209018 | A1 * | 11/2003 | Becke et al. | 62/126 |
| 2003/0230017 | A1 * | 12/2003 | Geyer | 40/544 |

FOREIGN PATENT DOCUMENTS

| | | |
|---|---|---|
| DE | 38 34 618 | 4/1990 |
| DE | 196 51 821 | 6/1998 |
| DE | 198 02 865 | 7/1999 |
| DE | 198 31 850 | 1/2000 |

(Continued)

OTHER PUBLICATIONS

International Search Report for PCT/EP2003/013723.

*Primary Examiner*—Sandra L O'Shea
*Assistant Examiner*—Sean P Gramling
(74) *Attorney, Agent, or Firm*—James E. Howard; Andre Pallapies

(57) ABSTRACT

A household appliance includes a front door having an upper edge, a front cover disposed in front of the front door; and an optical status display device mounted on the household appliance. The one optical status display device is hidden in a built-in state of the household appliance or is hidden when the front door is closed. The optical status display device is located at a spacing from the upper edge of the front door. The household appliance also includes a light guide for transmitting a signal light emitted by the optical status display device.

25 Claims, 7 Drawing Sheets

FOREIGN PATENT DOCUMENTS

Figure 1:
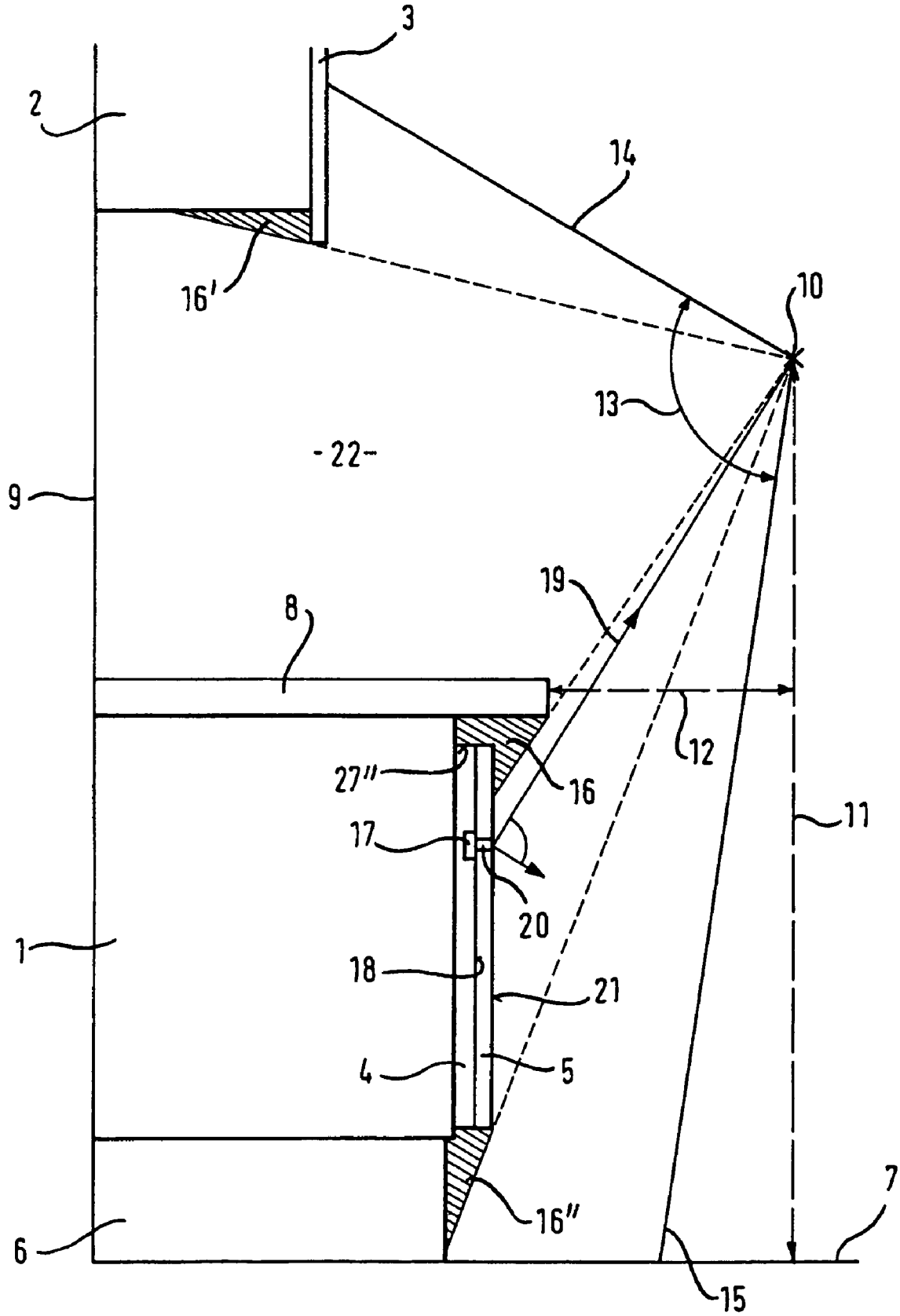

| | | | | | |
|---|---|---|---|---|---|
| DE | 198 59 976 | | 6/2000 | | |
| DE | 198 59 980 | | 6/2000 | | |
| DE | 200 14 556 | | 1/2001 | | |
| DE | 100 56 498 | | 5/2002 | | |
| EP | 0 396 915 | | 7/1994 | | |
| EP | 0 691 100 | | 5/1999 | | |
| EP | -1151717 | A2 * | 11/2001 | | |
| EP | 1 151 717 | | 12/2003 | | |
| GB | 2 044 427 | | 10/1980 | | |
| GB | 2 262 541 | | 6/1993 | | |
| GB | 2 340 257 | | 2/2000 | | |
| WO | WO 97/26486 | | 7/1997 | | |
| WO | WO-02-50804 | A2 * | 6/2002 | ..... | 40/544 |

* cited by examiner

HOUSEHOLD APPLIANCE, PARTICULARLY BUILT-IN HOUSEHOLD APPLIANCE

The invention relates to a household appliance, especially a built-in household appliance comprising a front cover disposed in front of a front door and at least one optical status display device which is hidden in a built-in state of the household appliance and/or when the front door is closed, and comprising at least one light guide for transmitting a signal light emitted by the optical status display device.

Various household appliances are known, such as kitchen household appliances for example which substantially comprise cookers, refrigerators and dishwashers. Especially in the case of refrigerators and dishwashers, so-called fully integrable household appliances are available where the entire front surface is provided with a front cover which can be matched to the surrounding furniture fronts. With a fully integrable household appliance, there is the problem that an optical status display device is hidden by the front cover when the front door of the fully integrable household appliance is closed so that the operating status of the fully integrable household appliance cannot be checked.

Known from EP 0 691 100 A1 is a built-in household appliance with a housing and a front door where a luminous signalling device is provided at the upper edge of the front door which displays a certain operating status of the appliance and which is hidden when the front door is closed. Between the upper edge of the front door and a surface running parallel to this edge, means are provided to transmit a light emitted by the luminous signalling device in the direction of the front side of the front door. DE 100 22 206 C2 describes a dishwasher which can be built in and has a pivotable door, which has a visual operating indicator with one or more light sources on its upper front face which is covered by a worktop lying on top of the dishwasher when the door is closed. A light conductor is connected to a vapour protection element fixed to the underside of the worktop via the appliance door and guides the signal light from the covered visual operating indicator to the front of the appliance.

The disadvantage of the devices used in EP 0 691 100 A1 and in DE 100 22 206 C2 is that the signal light in the light guide is poorly visible for a user standing in front of the built-in household appliance or dishwasher, since the light guide is located in a gap between the underside of the worktop and the edge of the appliance door and is covered by the worktop at the top. It is especially difficult to identify the signal light when using a thick front cover since in this way the light guide is additionally covered by the front cover from below.

Known from DE 100 45 236 A1 is a household appliance for mounting behind a front panel of a piece of furniture which comprises a pivotable front flap for fixing to the front panel of the piece of furniture and a handle which can be attached to said front panel in order to pivot the front flap. At least one display element, e.g. a light-emitting diode, is arranged on the handle to display an operating state of said built-in electrical appliance.

WO 97/26486 describes an electrical control device for a cooker which is attached in the handle of the cooker panel.

The disadvantage of the devices described in DE 100 45 236 A1 and in WO 97/26486 is that a power supply for the electrical display element or the electrical control device must be inserted in the handle starting from the household appliance or the cooker. In particular, there is a risk of the power supply in the handle being assembled incorrectly by the user.

It is the object of the invention to improve the visibility of the signal light of at least one optical status display device for a household appliance, especially a built-in household appliance.

This object is solved in a household appliance of the type specified initially by the optical status display device being located outside an upper edge of the front door.

Since the position of the optical status display device is not located on the upper edge of the front door but outside, the visibility of the signal light for a user is largely ensured in a simple fashion. In particular, the light guide can be arranged so that the signal light can be guided and/or transmitted and/or imaged in an area of the household appliance visible to a user so that the operating state of the household appliance can be checked even when the front door is closed.

If in particular, the front surface of the front door encompasses the optical status display device, an advantageous embodiment of the invention consists therein that at the position of the optical status display device the front cover has at least one through hole as far as the front side of the front cover, which surrounds at least one light guide. In this way, the formation and assembly of the light guide is especially easy since the signal light can be guided along a direct path from the optical status display device to the front side of the front cover.

In a further advantageous embodiment of the invention, a handle can be mounted on the front cover. This handle encompasses the light guide such that the signal light emitted by the optical status display device is visible in the handle. In this case, the necessary adaptation of the front cover is restricted to a small number of holes to fix the handle and guide the signal light from the front door into the handle. This is especially advantageous if the front door encompasses the optical status display device at a position where the handle is mounted on the front of the front cover.

If a side edge or a lower edge of the front door surrounds the optical status display device, a further advantageous embodiment of the invention consists therein that the light guide is displaceable. In this way, the light guide can be positioned so that the signal light is particularly clearly visible.

In a further advantageous embodiment of the invention, the light guide can be adapted to different thicknesses of the front cover in relation to its light guiding path. In this way, it is ensured that a sufficiently large area of the light guide is visible and is not covered by the front cover so that the signal light can be clearly identified by the user.

The invention substantially improves the visibility of the signal light of at least one optical status display device in a household appliance, especially in a built-in household appliance.

Figure 2:
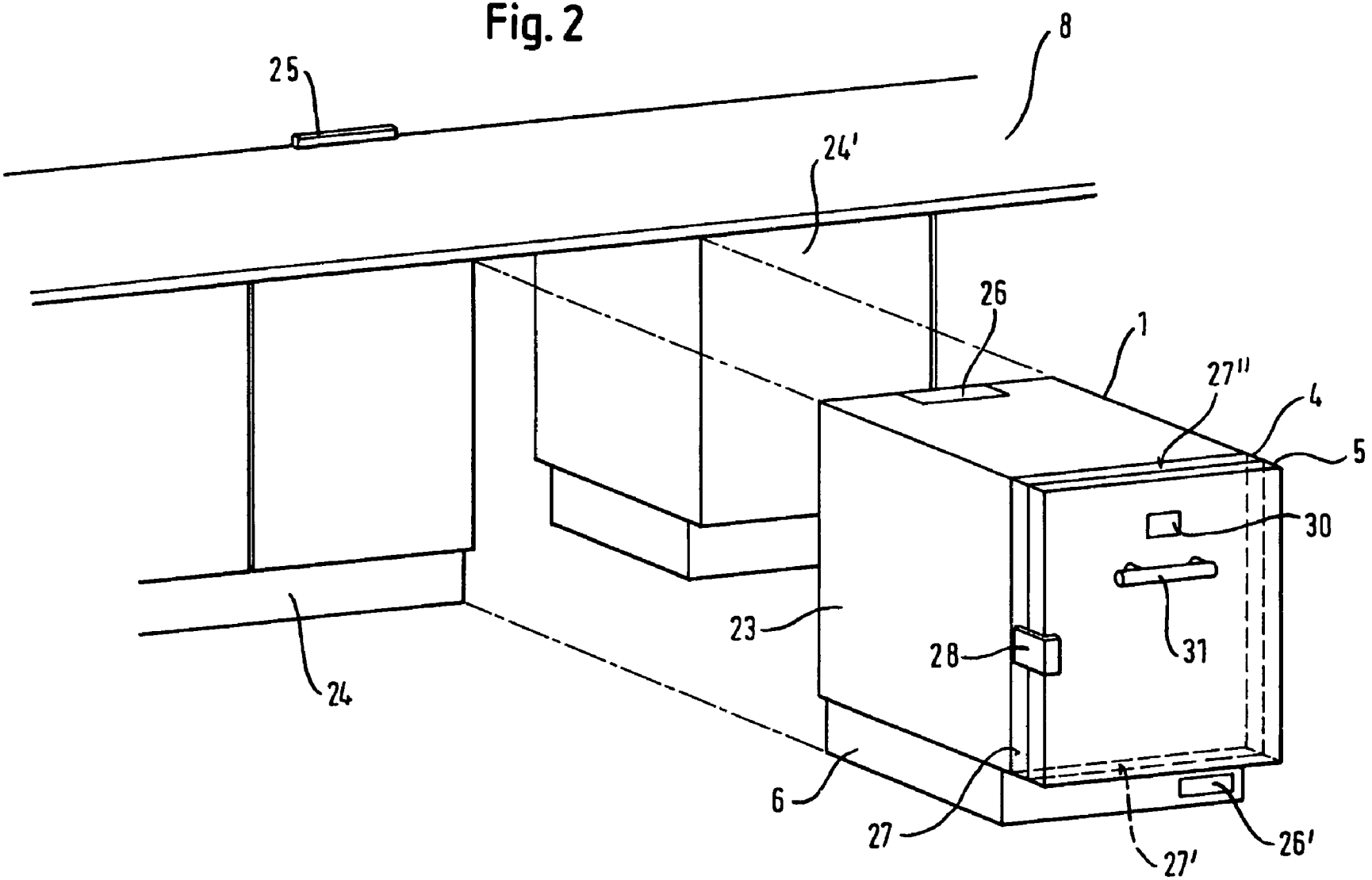
Figure 3:
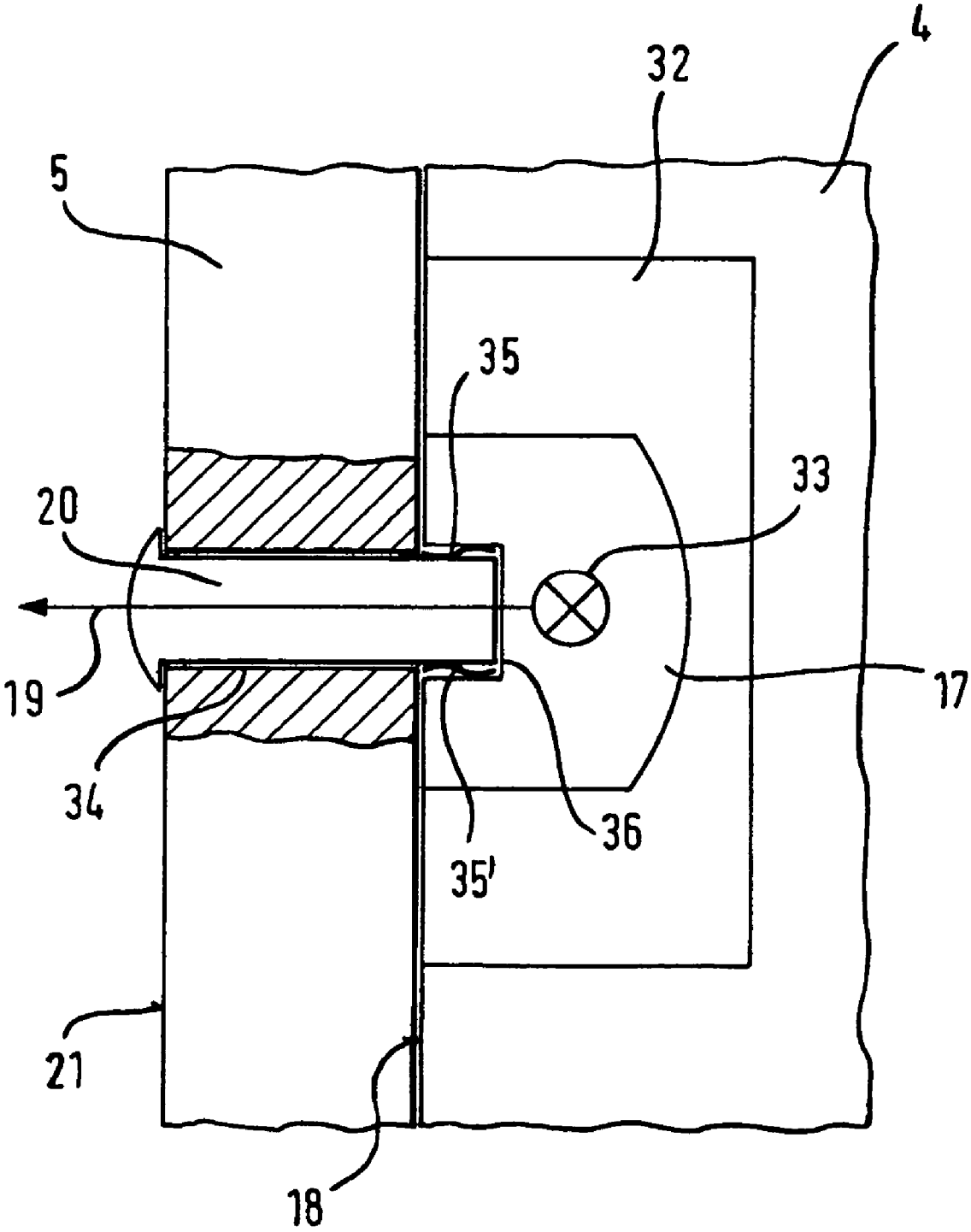
Figure 4:
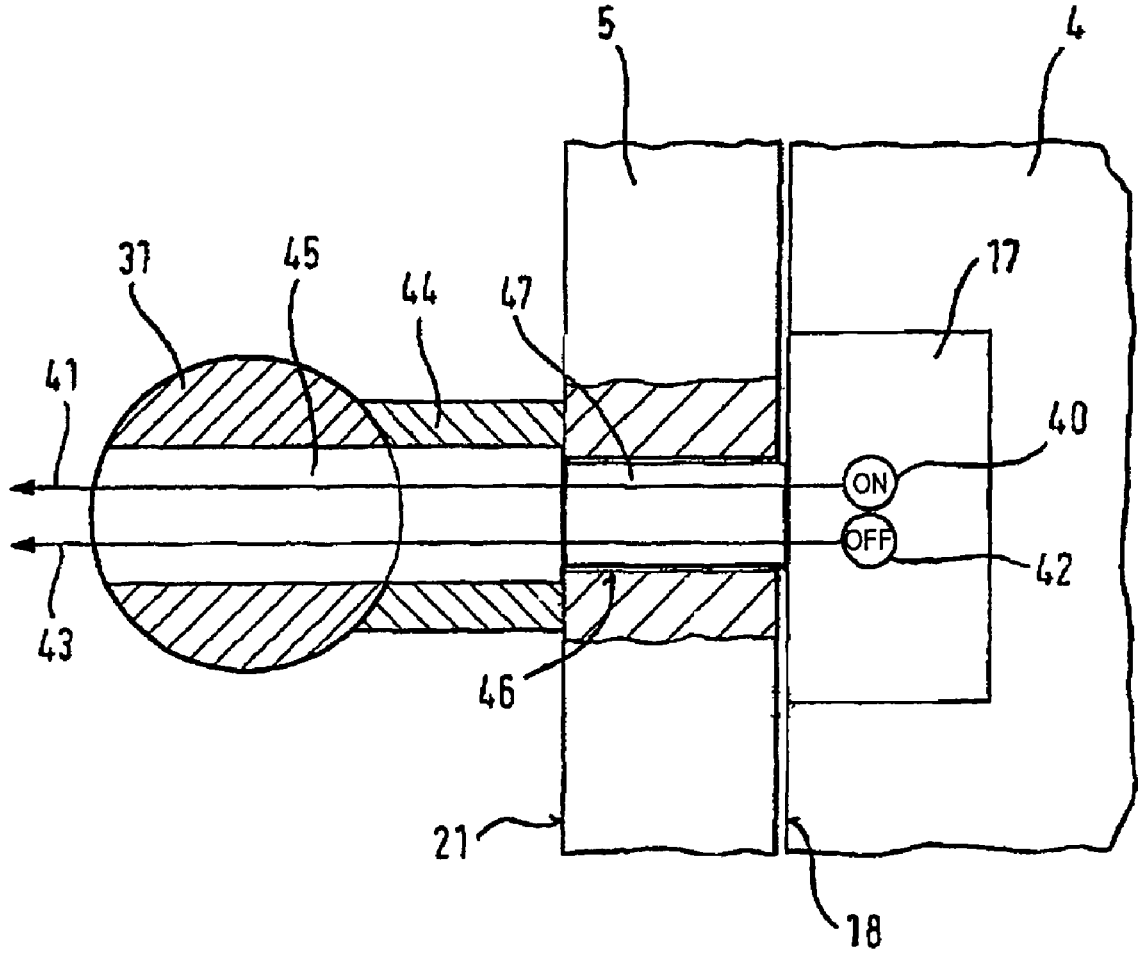
Figure 5:
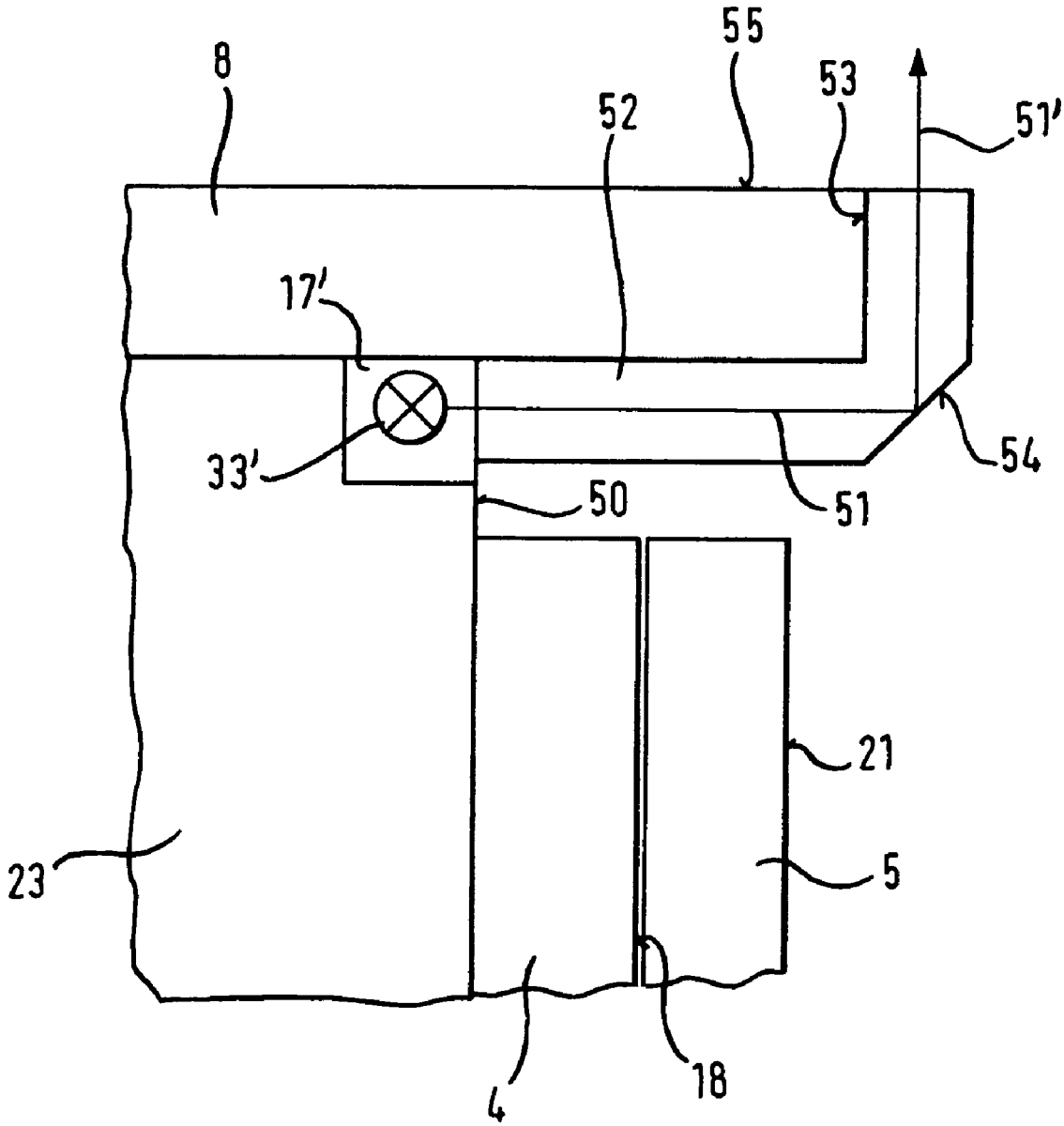
Figure 6:
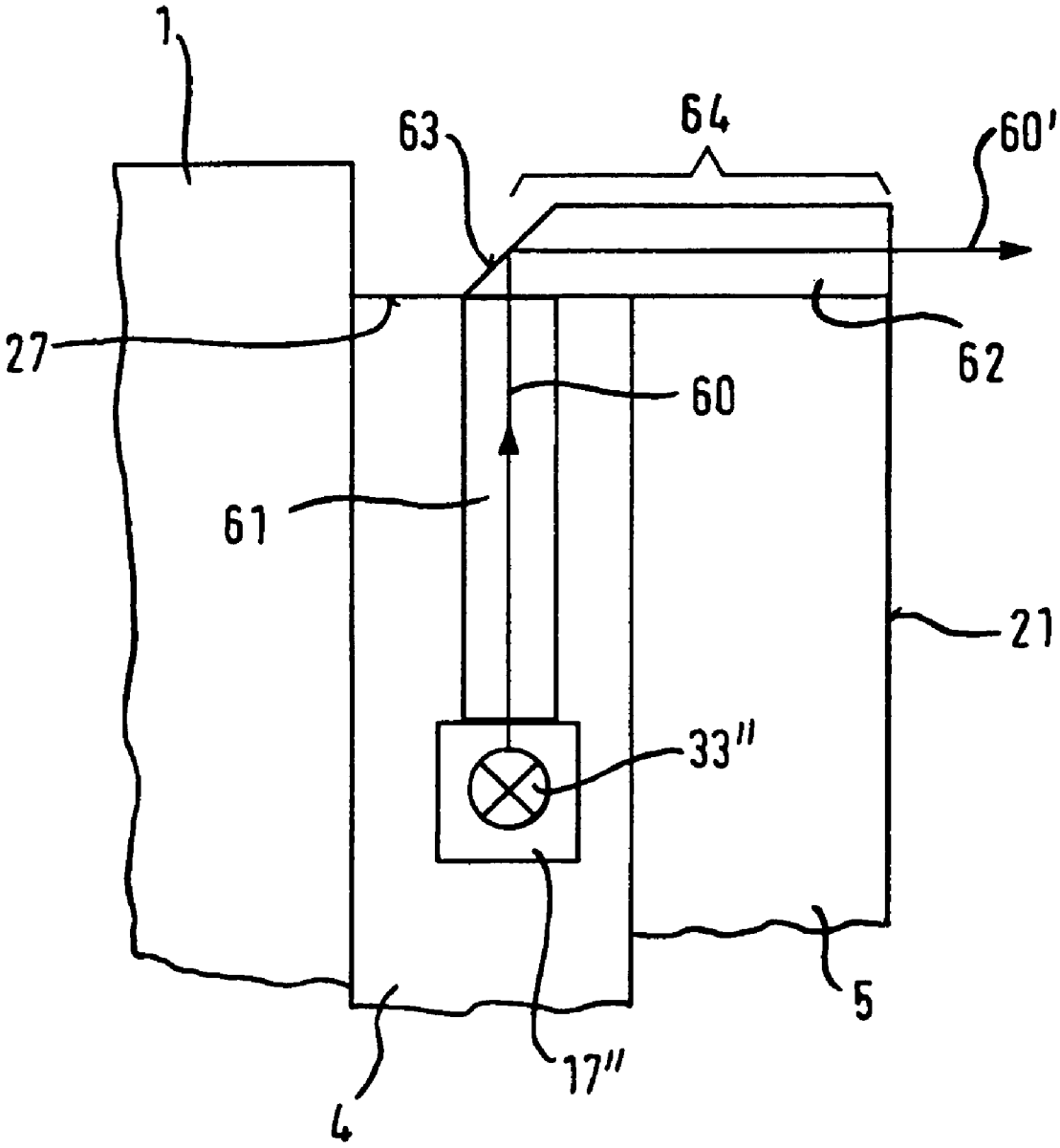
Figure 7:
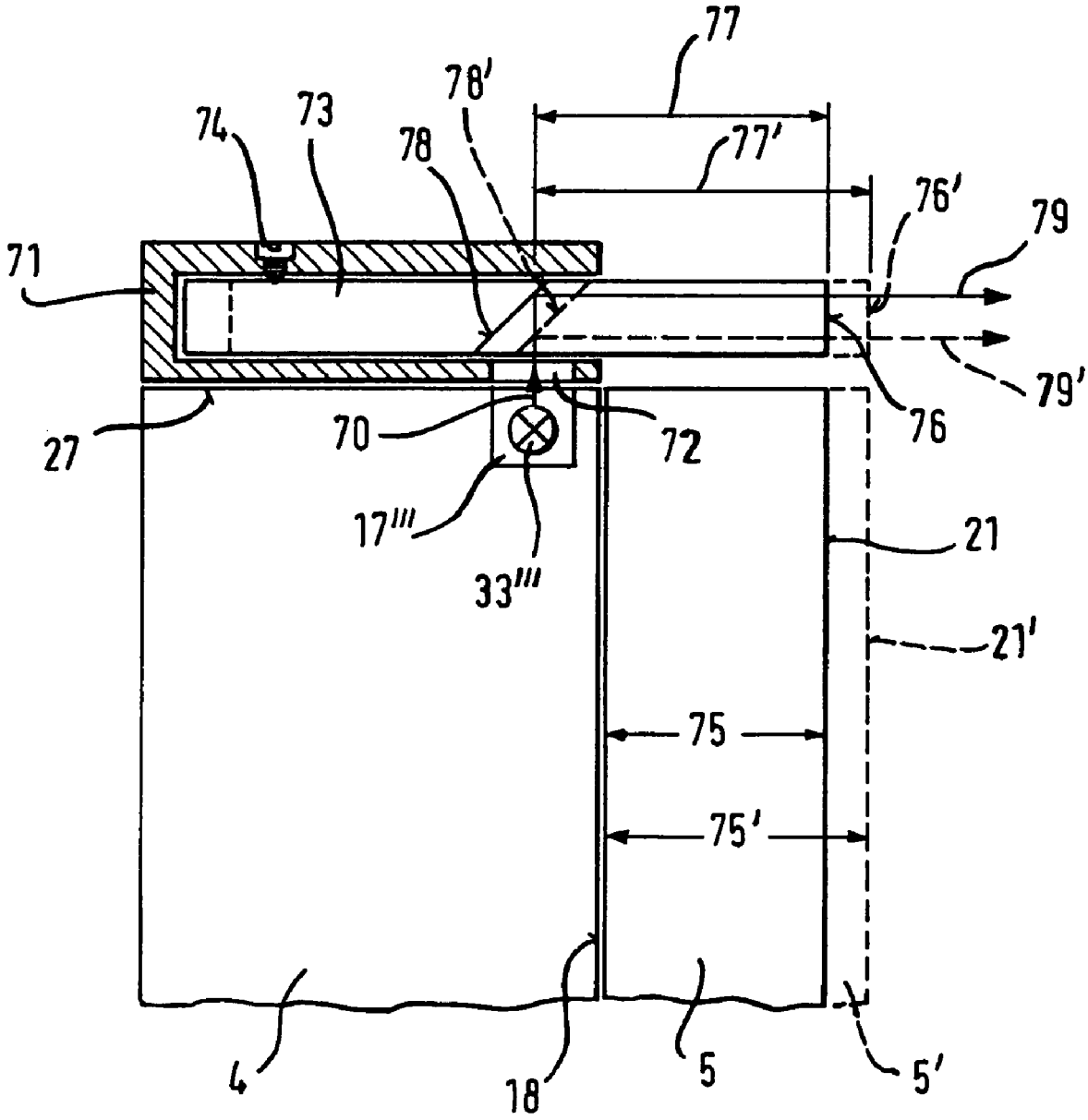

The invention and its further developments are explained in detail subsequently with reference to drawings. In the figures:

FIG. 1 is a schematic side view in cross-section through a kitchen line with a household appliance and a field of view of a user which illustrates a visible area for a signal light, FIG. 2 is a schematic perspective of the kitchen line with the household appliance from FIG. 1 pulled out, FIG. 3 is a schematic sectional view of a part of the household appliance from FIG. 2 with a front cover enclosing a light guide, FIG. 4 is a schematic sectional view of a part of the household appliance from FIG. 2 with a handle enclosing a light guide, FIG. 5 is a schematic sectional view of a part of the household appliance from FIG. 2 to illustrate a position of a light guide when the housing of the household appliance encompasses the optical status display device, FIG. 6 is a schematic sectional view of a part of the household appliance from FIG. 2 to illustrate a position of a light guide when the front door of the household appliance encompasses the optical status display device, FIG. 7 is a schematic sectional view of a part of the household appliance from FIG. 2 to illustrate adaptation of the light guide to different thicknesses of the front cover.

The kitchen line shown schematically in side view in FIG. 1 consists of a top cupboard 2 with a door 3 and a household appliance 1 which especially is a dishwasher or a refrigerator, with a front door 4 and a front cover 5. The household appliance 1 stands on the floor 7 with a base 6 and is covered by a worktop 8. The top cupboard 2 and the household appliance 1 with the worktop 8 and base 6 are attached directly to the wall 9.

FIG. 1 further shows a field of view of a user which illustrates a visible range for a signal light 19. A user 10 with an average eye height 11 of 150 centimeters is located a distance 12 in front of the worktop 8 which is typically no more than 30 centimeters. A field of view 13 of the user 10 is restricted by the upper limit 14 and the lower limit 15. In this field of view 13 there is a first non-visible region 16 underneath the worktop 8 which is obscured by the worktop 8, a second non-visible region 16' behind the door 3 of the top cupboard 2 which is obscured by the door 3 of the top cupboard 2 and a third non-visible region 16" in the area of the base 6 underneath the front door 4 and the front cover 5 of the household appliance 1 which is obscured by the front cover 5.

The signal light 19 is emitted by the optical status display device 17 located on the front face 18 of the front door 4 and is transmitted by means of the light guide 20 to the front side 21 of the front cover 5. The visible region 22 for this signal light is determined by the upper limit 14 and the lower limit 15 of the field of view 13 except for the obscured areas 16, 16' and 16" shown hatched.

As is described in FIG. 1, it is especially advantageous if the light guide 20 transmits the signal light 19 in the direction of the front side 21 of the front cover 5 and into the visible region 22 for the user 10 since the operating status of the household appliance 1 can thus be checked by the user 10 even when the front door 4 is closed without the user 10 needing to change his position.

The household appliance 1 comprising a housing 23, front door 4, front cover 5 and base 6, shown in the schematic perspective in FIG. 2 drawn out from the kitchen line, is built in between two built-in cupboards 24 and 24' and is covered by a worktop 8.

In FIG. 2 the household appliance 1 is shown pulled out from the kitchen line in order to clearly show various positions to which the signal light 19 of the optical status display device 17 can be transmitted using light guides. One possible visible position for the signal light 19 is on a rear edge 25 of the worktop 8 if the optical status display device 17 is located, for example, at the position 26 of the housing 23 of the household appliance 1. Alternatively, the signal light 19 can be guided into a region 26' of the base 6. In this way, the signal light 19 can be guided to positions of the visible region 22 located outside the front side 21 of the front cover 5.

If the optical status display device 17 is located, for example, on a side edge 27 of the front door 4, the signal light 19 can be guided to the front side 21 of the front cover 5 by means of the light guide 28.

If the front door 4 encompasses the optical status display device 17, it is possible to guide the signal light 19 to the front side 21 of the front cover 5 using the light guide 20 located in a through hole in the front cover 5. In this way, the signal light 19 is especially clearly visible since it can be guided on a direct path from the optical status display device 17 into the visible region 22.

An alternative possibility is to guide the signal light 19 into a handle 31 which for example, is a glass or plastic light guide and which is mounted on the front cover 5. In this case, the entire handle 31 can be used to make the signal light 19 visible.

An advantageous further development consists in providing a plurality of light guides 28, 30 to transmit signal light 19 pertaining to different operating states ON, OFF since in this way the different operating states ON, OFF can be displayed by the signal light 19 at different positions.

It is especially advantageous if in addition, light guides 28, 30 of different colour, e.g. red and green, are provided for displaying the different operating states ON, OFF. If, for example, the light guide 28 is red and the signal light of the operating state ON is transmitted therewith and the light guide 30 is green and the signal light of the operating state OFF is transmitted therewith, the different operating states ON, OFF can be especially easily identified by the user 10 using the different colour red and green and using the different positions 28 and 30.

FIG. 3 shows another embodiment of the invention wherein the front door 4 of the household appliance 1 encompasses a control system 32 with an optical status display device 17 which for its part encompasses a light-emitting diode 33 which emits a signal light 19. At the position of the optical status display device 17 the front cover 5 has a through hole 34 as far as the front side 21 of the front cover 5 which is especially executed as cylindrical. The hole 34 surrounds the light guide 20 which is fixed flush to the optical status display device 17 by means of two clamps 35 and 35' located in a recess 36 of the status display device 17. The signal light 19 emitted by the light-emitting diode 33 can in this way be coupled directly into the light guide 20 and is guided by the light guide 20 to the front side 21 of the front cover 5 so that the signal light 19 is visible there.

An advantage of this design is that the signal light 19 is guided rectilinearly to the front side 21 of the front cover 5 and it is not necessary to deflect it using reflecting surfaces. In this way, the light guide 20 can be formed simply by a piece of cylindrical glass or plastic whereby the light guide 20 is very inexpensive.

If a plurality of optical status display devices 17 are provided on the front door 4 of the household appliance 1, the embodiment described above can be provided in multiple form. In addition, the hole 34 can be configured so that it surrounds a plurality of light guides 20 which are arranged next to one another and/or under one another.

FIG. 4 shows a further embodiment of the invention wherein a handle 31 encompasses a light guide 45. The front door 4 of the household appliance 1 encompasses an optical status display device 17, comprising a red light-emitting diode 40 which emits a red signal light 41 and signals the operating state ON and comprising a green light-emitting diode 42 which emits a green signal light 43 and signals the operating state OFF.

Mounted on the front side 21 of the front cover 5 using a holder 44 is the handle 31 which encompasses a light guide 45 which extends through the holder 44 as far as the front side 21 of the front cover 5. In the hole 46 of the front cover 5 another light guide 47 which is fixed flush to the optical status display device 17, is adjacent to the light guide 45 of the handle 31.

The signal light 41 and 43 emitted by the light-emitting diodes 40 and 42 is coupled in this way into the light guide 47 and is guided therefrom to the front side 21 of the front cover 5. From there the signal light 41 and the signal light 43 goes over into the light guide 45 of the handle 31 so that the signal light 41 or the signal light 43 is visible in the handle 31 according to the operating state ON or OFF.

In this way, when the front door 4 of the household appliance 1 is closed the user 10 can at least determine whether the household appliance 1 is switched on or off. This is especially advantageous if the household appliance 1 is a dishwasher since in this case, unintentionally opening the front door 4 in the switched-on operating state ON can result in water escaping.

By using light-emitting diodes 40, 42 of different colour, the same light guides 47 can be used to signal the different operating states ON, OFF since the different operating states ON, OFF can be distinguished as a result of the different colours of the signal light 41, 43. In particular, the optical status display device 17 can comprise a plurality of light-emitting diodes with different colours for indicating a plurality of different operating states. Also the choice of colours for the operating states ON and OFF is not limited to red and green. Other illuminants, such as incandescent lamps for example can also be used instead of light-emitting diodes.

FIG. 5 shows another embodiment of the invention wherein a housing 23 of the household appliance 1 at the front side 50 of said household appliance 1 directly underneath the worktop 8 encompasses the optical status display device 17' with a light-emitting diode 33' which emits a signal light 51 in the direction of the front side 21 of the front cover 5.

Affixed underneath the worktop 8 is a light guide 52 which guides the signal light 51 from the optical status display device 17' over the front door 4 of the household appliance 1 and over the front cover 5 in the direction of the front side 21 of the front cover 5. The light guide 52 encompasses the worktop 8 at its front face 53 at right angles such that the signal light 51 is reflected at a sloping light-reflecting surface 54 of the light guide 51 perpendicular to the surface 55 of the worktop 8 so that the reflected signal light 51' is clearly visible.

FIG. 6 shows another embodiment of the invention wherein outside the side edges 27, the lower edge 27' and the upper edge 27" a front door 4 of the household appliance 1 encompasses an optical status display device 17" with a light-emitting diode 33" which emits a signal light 60 in the direction of the side edge 27 of the front door 4. At the optical status display device 17" a first part of the light guide 61 is arranged such that the signal light 60 can be transmitted from the optical status display device 17" to the side edge 27 of the front door 4. This first part of the light guide 61 can also consist of a bundle of glass or plastic fibres.

Located at the side edge 27 of the front door 4 is a second part of the light guide 62 at right angles to the first part of the light guide 61. This second part of the light guide 62 comprises an oblique light-reflecting surface 63 so that the signal light 60 is reflected from this surface 63 in the direction of the front side 21 of the front cover 5. The second part of the light guide 62 guides the reflected signal light 60' over the front cover 5 so that the reflected signal light 60' is visible on the front side 21 of the front cover 5.

If the optical status display device 17" emits the signal light 60 in the direction of the lower edge 27' or the upper edge 27" of the front door 4, the arrangement of the first part of the light guide 61 and the second part of the light guide 62 described above can be provided at the lower edge 27' or the upper edge 27" of the front door 4. In particular, the first part of the light guide 61 can consist of a bundle of glass fibres or plastic fibres. Since the fibres are flexible, the first part of the light guide 61 can be curved in this case, whereby the signal light 60 can also be guided from positions of the optical status display device 17" to the edges 27, 27', 27" which are barely accessible with rigid light guides 61.

The arrangement described above is especially advantageous if the second part of the light guide 62 is displaceable with respect to the first part of the light guide 61, as described hereinafter for FIG. 7 since the length of the light-guiding path 64 can be adapted to the different thickness of the front cover 5 in this way. This ensures that a sufficiently large area of the second part of the light guide 62 is visible for the user 10 so that the signal light 60' can be clearly identified.

FIG. 7 illustrates an adaptation of a light guide to different thickness of the front cover.

The side edge 27 of the front door 4 of the household appliance 1 encompasses an optical status display device 17" with a light-emitting diode 33" which emits a signal light 70 perpendicular to the side edge 27. Mounted on the side edge 27 is a clip 71 with a recess 72 at the position of the optical status display device 17". The clip 71 encompasses a light guide 73 into which the signal light 70 is coupled through the gap 72. The light guide is displaceable in the clip 71 parallel to the side edge 27 and can be fixed in the clip 71 using a countersunk screw 74.

For a front cover 5 having a thickness 75, the light guide 73 is displaced so that its front face ends in a position 76 with the front side 21 of the front cover 5, In this way, the light-guiding path 77 is adapted to the thickness 75 of the front cover 5. For a front cover 5' having a thickness 75', the light guide 73 is displaced so that its front face ends at a position 76' with the front side 21' of the front cover 5'. In this way the light-guiding path 77' is adapted to the thickness 75' of the front cover 5'.

Furthermore, the light guide 73 comprises an oblique light-reflecting surface 78 which is located at the position 78 or 78' according to the thickness 75 or 75' of the front cover 5 or 5'. In this way, it is ensured that for different thicknesses 75 or 75' of the front cover 5 or 5' the reflected signal light 79 or 79' is reflected at right angles in the direction of the front side 21 or 21' of the front cover 5 or 5' and is clearly visible there, as is described in FIG. 6.

The invention substantially improves the visibility of the signal light of at least one optical status display device 17 in a household appliance 1, especially a built-in household appliance.

The invention claimed is:

1. A household appliance comprising:

a front door having an upper edge, the front door being opened and closed to access an appliance interior space;

a front cover disposed in front of the front door;

at least one optical status display device mounted on the household appliance such that the one optical status display device is a selected one of hidden in a built-in state of the household appliance and hidden when the front door is closed; and at least one light guide for transmitting a signal light emitted by the optical status display device, the optical status display device being located at a spacing from the upper edge of the front door, wherein the light guide is arranged so that the signal light is disposed in the front cover so that the light is transmitted in the direction of the front side of the cover.

2. The household appliance according to claim 1, wherein the signal light is guided by the light guide to an area of the household appliance that is visible to a user so that the operating status of the household appliance can be checked even when the front door is closed.

3. The household appliance according to claim 1, wherein the front door has a front surface, the front cover is disposed in front of the front surface of the front door, and the optical status display device is mounted at the front surface of the front door.

4. The household appliance according to claim 3, wherein the front cover has a rear surface facing the front surface of the front door and a front surface in opposition to the rear surface, the optical status display device is mounted on the front door, the front cover has at least one through hole extending as far as the front side of the front cover, and the one through hole surrounds the light guide.

5. The household appliance according to claim 4, wherein the through hole is substantially cylindrical.

6. The household appliance according to claim 4 further comprising a handle mounted on the front cover, wherein the light guide is disposed relative to the handle such that the signal light emitted by the optical status display device is visible in the handle.

7. The household appliance according to claim 6, wherein the handle is a light guide.

8. The household appliance according to claim 1, wherein the front door has a side edge and a lower edge and the optical status display device is mounted at a selected one of the side edge and the lower edge of the front door.

9. The household appliance according to claim 8, wherein the light guide is a displaceable light guide.

10. The household appliance according to claim 1, wherein the front door has a side edge and a lower edge and the optical status display device is located at a spacing from the upper edge, the side edge, and the lower edge of the front door.

11. The household appliance according to claim 10, wherein the front cover has a rear surface facing the front surface of the front door and a front surface in opposition to the rear surface, a first part of the light guide is arranged such that the signal light is transmitted from the optical status display device to one of the upper edge, the side edge, and the lower edge of the front door, and a second part of the light guide is arranged such that the signal light is transmitted at least as far as the front side of the front cover.

12. The household appliance according to claim 11, wherein the second part of the light guide is displaceable with respect to the first part of the light guide.

13. The household appliance according to claim 1 and further comprising a housing, the optical status display device being mounted in the housing.

14. The household appliance according to claim 1, wherein the light guide guides the signal light along a light guiding path and the light guiding path is adaptable to extend through the respective thickness of the front cover.

15. The household appliance according to claim 1, wherein the light guide is mounted flush to the optical status display device.

16. The household appliance according to claim 1, wherein the light guide comprises at least one glass fiber.

17. The household appliance according to claim 1, wherein the light guide comprises at least one plastic fiber.

18. The household appliance according to claim 1, wherein the optical status display device is operable to provide a signal indicating at least the operating states (ON, OFF) of the respective switched-on and switched-off states of the household appliance.

19. The household appliance according to claim 1, wherein the optical status display device comprises at least one light-emitting diode.

20. The household appliance according to claim 1, wherein the optical status display device is operable to emit a signal light of a different color indicating a respective different operating state.

21. The household appliance according to claim 1 and further comprising a plurality of light guides to transmit signal light pertaining to different operating states.

22. The household appliance according to claim 21, wherein the light guides are comprised of different colors to display different operating states.

23. The household appliance according to claim 1, wherein the household appliance is a selected one of a dishwasher and a refrigerator.

24. The household appliance according to claim 1, wherein the optical status display device is located at the spacing from the upper edge of the front door such that the optical display device is within a visible region of a field of view of a user standing in front of the household appliance.

25. A household appliance comprising:

a front door having an upper edge, the front door being opened and closed to access an appliance interior space;

a front cover disposed in front of the front door;

at least one optical status display device mounted on said front door such that the one optical status display device is a selected one of hidden in a built-in state of the household appliance and hidden when the front door is closed; and at least one light guide for transmitting a signal light emitted by the optical status display device, the optical status display device being located at a spacing from the upper edge of the front door, wherein the light guide is arranged so that the signal light is disposed in the front cover so that the light is transmitted in the direction of the front side of the cover, wherein the optical status display device emits a first signal light for at least a first appliance status and at least a second signal light, different from the first signal light, for at least a second appliance status.

* * * * *